US005122014A

United States Patent [19]

Genfan

[11] Patent Number: 5,122,014

[45] Date of Patent: Jun. 16, 1992

[54] BEACH ANCHORING DEVICE

[76] Inventor: German S. Genfan, 29 Keller Path, Newton, Mass. 02159

[21] Appl. No.: 710,971

[22] Filed: Jun. 6, 1991

[51] Int. Cl.[5] ..... E02D 5/54

[52] U.S. Cl. ..... 405/244; 52/157; 248/156; 248/533; 405/232

[58] Field of Search ..... 405/244, 232, 231; 52/157, 155; 248/156, 533, 545

[56] References Cited

U.S. PATENT DOCUMENTS

| | | | |
|---|---|---|---|
| 728,609 | 5/1903 | Pitcher | 52/157 X |
| 1,736,177 | 11/1929 | Snook | 52/157 |
| 2,643,843 | 6/1953 | Brown | 52/157 X |

FOREIGN PATENT DOCUMENTS

| | | | |
|---|---|---|---|
| 1383253 | 11/1964 | France | 52/157 |

*Primary Examiner*—Dennis L. Taylor

[57] ABSTRACT

A beach anchoring device for easy and reliable installation and fast removal of the stick-like objects, mainly beach umbrellas, on sand/soft ground beaches. Also might be used to anchor fishing rods, tents, canopy posts and other post-supported structures mainly on beaches. The device includes a tubular pole 1 with centering projection 6 and slightly twisted propeller-like blandes 5, and a handle 2, that fits the holes 7 in the pole 1. The pole might be screwed in the sand by the handle inserted in the holes 7. When installed in the sand, the handle is removed from the holes and an umbrella is inserted into the pole together with the handle which locks the umbrella stick in it. The sand that partly fills the pole is compacted by the umbrella stick and, interacting with the bottom end portions of the pole provides reliable anchorage. To remove the device, it should be screwed out of the sand.

1 Claim, 2 Drawing Sheets

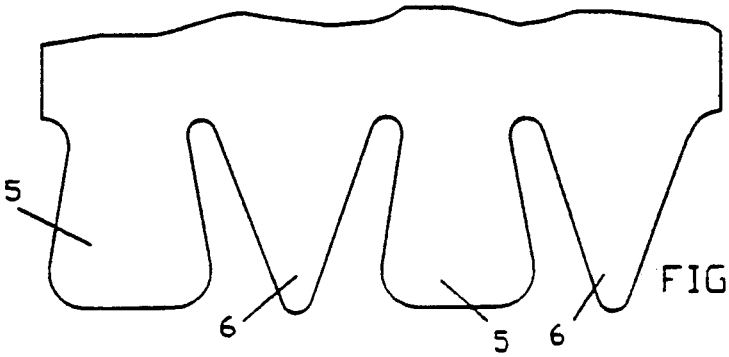
FIG. 2
FIG. 3
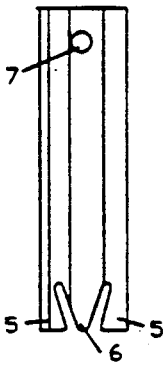
FIG. 4
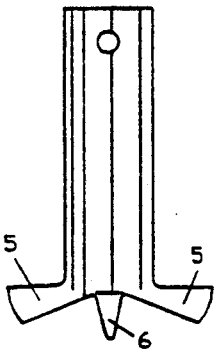
FIG. 5
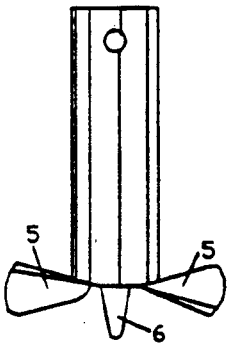
FIG. 6
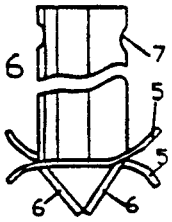
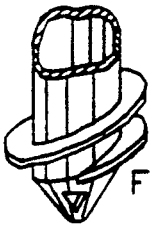
FIG. 7

BEACH ANCHORING DEVICE

FIELD OF INVENTION

The invention herein presented relates to hand driven anchoring devices for temporary installation of stick-like objects, mainly beach umbrellas, in a soft ground, mainly in beach sand. It might also be used to anchor fishing rods, tents, posts for canopies and other post-supported structures mainly on beaches.

BACKGROUND OF THE INVENTION

The conventional beach anchoring devices mostly are of two types: A) thrust-in solid type, and B) thrust-in tubular type. The type "A" is mostly used for anchoring beach umbrellas by means of a conical bottom end of an umbrella's stick which is thrusted in the sand. The type "B" is mostly used for anchoring fishing rods by means of a separate tube with an obliquely cut bottom end in which a fishing rod is inserted, after the tube is thrusted into the ground. The devices of both types are difficult to thrust into the sand deeply enough (sometimes they should be digged in). Besides, they do not provide good stability in the sand, especially those for umbrellas, because an umbrella works as a sail and its bottom end might be highly loaded when the wind blows.

It is desirable for a beach anchoring device to be installed into the sand in an easier way as compared to thrusting in. It is also desirable for the device to have more stability when installed in the sand.

The tubular-type devices having a screw-like structure on their outside portion are also known (see, for example, French Patent No. 1,383,253, Int. Cl. FO6b). Operatively bottom end of those devices is closed by usually conical cap. Because of the cap (its shape does not matter) the tubular portion of the device is a "passive portion"—it does not have any cutting edges and should be inserted into the sand. It means that during the device installation, resistance of the sand will be in proportion to the "passive portion" cross-section area (approx. 1 sq. inch) causing idle-turning and, in turn, loosening the sand around the device. It impairs stability of the device in the sand. Also, significant additional thrusting in force should be applied by an operator.

SUMMARY OF THE INVENTION

The invention herein presented is a beach anchoring device comprising of a tubular pole and a handle, said pole, on one of its ends, having symmetrically disposed blades twisted a little in order to provide a propeller-like structure and also having a centering projection aligned with a longitudinal center line of said pole, providing that in between said propeller-like structure and said centering projection there are openings big enough to allow the sand particles to go thru and inside said pole, and on its opposite end, having a receptacle that fits said handle to operatively rotate said pole. The receptacle comprises two holes aligned with each other on both sides of said pole, and the handle that is a rod that fits said holes. The inside dimension of said pole is big enough to operatively tightly receive both an umbrella stick and said handle.

To use the beach anchoring device one needs to insert the handle into the receptacle hole in the pole, put the pole vertically on the beach sand and rotate it clockwise (the blades should be twisted accordingly) by the handle until it is completely screwed into the sand. During this pole rotation the centering projection will soften the sand and lead the device movement, the twisted blades will force the device downward, and the inside portion of the pole will be partly filled with the sand through the openings in between the blades and the centering projection.

One can see that operatively bottom end of the proposed device is not closed and the "passive portion" cross-section area now is equal to the pole's wall thickness (approx. 0.06") times the centering projection length (approx. 1") times 2 (there are two centering projection portions), which is 0.12 sq. inch, or eight times smaller than that of the known devices. It means that idle-turning is low (if any) and the sand around the device pole will not be loosened providing its stability. It also means that there is no need any more in operator's thrusting in force.

After the pole is screwed in the sand, one needs to remove the handle, insert (applying some force downward) an umbrella stick (or fishing rod, or canopy post, etc.) into the pole of the device and lock it by inserting the handle in a space provided in between the stick and the pole wall. The sand inside the pole will be compacted by the umbrella stick when it is forced downward for being inserted and by weight of the umbrella. This compacted sand will interact with the blades and the centering projection and contribute to stable position of the device in the sand.

Compared to traditional devices, the present invention gives the anchorage in the beach sand more convenience and reliability.

DRAWINGS

FIG. 2 is a development of the anchoring portion of the device if fabricated of a sheet metal;

FIG. 3 is a front view of a device after notching slots if fabricated of tubing (or after the development according to FIG. 1 is rolled);

FIG. 4 is a front view of the device after bending blades up and centering projection down;

FIG. 5 is a front view of the device after twisting blades;

FIG. 6 is a side view of the device according to FIG. 5;

FIG. 7 is an isometric view of the anchoring device option made of plastic or plastic-related material.

DETAILED DESCRIPTION

Figure 1:
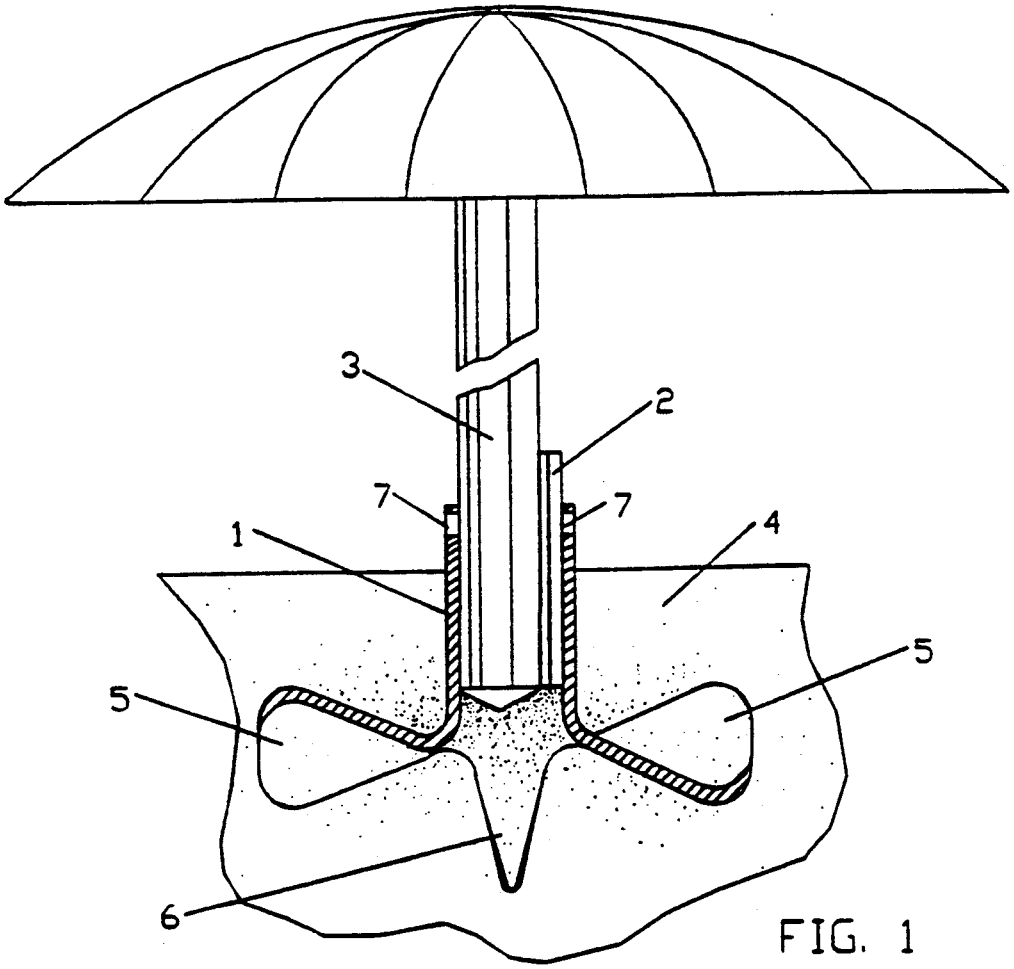
FIG. 1 is a sectional view of the beach anchoring device according to the present invention in working position.

Referring to the drawings FIG. 1 shows a pole 1 of the beach anchoring device according to the invention in sectional view (in working position) with handle 2 and an umbrella stick 3 installed in a beach sand 4. The pole 1 of the anchoring device has a tubular shape. On its bottom (FIG. 1) portion two blades 5 and a centering projection 6 are formed. Blades 5 are bent up to the straight line which is perpendicular to the longitudinal axes of the pole 1. Portions of the material of the pole 1 which form the centering projection 6 are bent down to center line of the pole 1. Besides, the blades 5 are slightly twisted in order to create a propeller-like structure.

The direction of twisting the blades 5 is chosen in such a way that the pole 1 moves downward when rotated clockwise and being positioned as shown on FIG. 1. In other words, the twisted blades 5 should create a kind of a right-hand thread. On the upper (according to FIG. 1) portion of the pole 1 there is a receptacle 7, which, as described in the main implementation of the invention, is a hole through the both sides of the pole 1. This hole is to receive the handle 2 when the pole 1 is screwed down into the beach sand 4.

In order to install this device in the beach sand, one should insert the handle 2 into the hole 7, put the device vertically on the sand with the centering projection 6 down, and rotate it clockwise by the handle until it is almost completely screwed into the sand. The handle 2 should be removed in order to insert the umbrella's stick 3 into the pole 1. The handle 2 is then also inserted into the pole 1 to achieve tight holding of the umbrella's stick. By the force of the insertion of an umbrella stick and by the weight of the umbrella, the sand, which partly fills the pole 1 through openings in between the blades 5 and the centering projection 6, will be compacted and the dense sand bulk around the bottom portion of the device will be created.

The construction of the anchoring device will be more clear from further description of steps and options of its fabrication process. The main implementation of the device might be fabricated either of sheet metal or tubing. For the sheet metal fabrication a piece of thin (approx. 16 GA ASS) metal should be developed as shown on FIG. 2. Portions 5 on FIG. 2 are blade development, portions 6 are centering projection development. In the next step of the fabrication process herein described, the developed piece of metal should be rolled in order to create the tubular part shown on FIG. 3. (Creation of the hole 7 is obvious and not described here). The next steps of the process are the same whether it is fabricated of sheet metal or tubing, provided that for tubing option the step shown on FIG. 3 is the first one in the process.

As one can see on FIG. 3, both blades 5 and the centering projection 6 might be created by punching two slots through both sides of the tubing. The slots mentioned should be symmetrically situated and slanted a little from the center line as shown on FIG. 3. The next step is bending the blade portions 5 up to the line which is perpendicular to the longitudinal axis of the tubing and also bending the projection portions 6 down to the center line of the tubing (FIG. 4). The last step of the process (FIG. 5) is slightly twisting the blades 5 in order to create a propeller-like structure. Thus, the blades 5 have trapezoidal shape and centering projection has triangular shape, as seen from FIG. 2. On FIG. 6 one can see the opening in the bottom portion of the device, through which the sand might partly fill the inside portion of the tubing when the device is being installed in the sand.

It has to be understood that the general idea of the invention herein described, and the implementation could be modified in different ways. For example, the device might be made of plastic or plastic-related material. In that case, perfect screw-like thread and full cone at the bottom portion of the device could be created by forming in a mold (FIG. 7). The windows in the cone might also be formed for the sand to partly fill the pole of the device and to be compacted by an umbrella stick.

Thus, the device that can be anchored in the beach sand/soft ground without being thrusted in is created. Compared to the conventional devices, the beach anchoring device according to the invention, gives the beach umbrella's more stability in the sand because its comparatively big bottom area (which includes blades and centering projection) interacts with a compacted sand.

What I claim is:

1. A beach anchoring device comprising a tubular pole and a handle, said pole, on one of its end portions, having symmetrically disposed blade means slightly twisted in order to provide a propeller-like structure and also having a centering projection aligned with the longitudinal center line of said pole, providing that in between each portion of said propeller-like structure and said centering projection there are openings big enough to allow sand particles to go through and inside said pole, and on its opposite end portion, having a receptacle that fits said handle to operatively rotate said pole, wherein said blade means consist of two trapezoidal shaped portions, and said centering projection consists of two triangular shaped portions which are formed on the operatively bottom portion of said tubular pole by means of two slots through both sides of said tubular pole with said blade portions each being bent up to a 90 degree angle and slightly twisted, and said centering projection portions each being bent down to longitudinal center line provided that said slots are symmetrically disposed relatively to the center line of said pole and slightly slanted converging to the operatively bottom end of said pole.

* * * * *